US005263700A

United States Patent [19]

Tubb et al.

[11] Patent Number: 5,263,700

[45] Date of Patent: Nov. 23, 1993

[54] FEEDING OF FLEXIBLE SHEETS

[75] Inventors: Anthony B. Tubb, Nuneaton; Michael A. Nash, Coventry, both of United Kingdom

[73] Assignee: Courtaulds Textiles (Holdings) Limited, Manchester, United Kingdom

[21] Appl. No.: 678,286

[22] PCT Filed: Oct. 3, 1989

[86] PCT No.: PCT/GB89/01171

§ 371 Date: Apr. 3, 1991

§ 102(e) Date: Apr. 3, 1991

[87] PCT Pub. No.: WO90/03936

PCT Pub. Date: Apr. 19, 1990

[30] Foreign Application Priority Data

Oct. 4, 1988 [GB] United Kingdom ..... 8823269

[51] Int. Cl.[5] ..... B65H 3/08

[52] U.S. Cl. ..... 271/20; 271/97

[58] Field of Search ..... 271/97, 20, 98

[56] References Cited

U.S. PATENT DOCUMENTS

| | | | |
|---|---|---|---|
| 2,791,424 | 5/1957 | Noon | 271/28 |
| 3,136,539 | 6/1964 | Lyman | 271/97 |
| 3,158,367 | 11/1964 | Tarbuck | 271/26 |
| 3,168,307 | 2/1965 | Walton et al. | 271/26 |
| 3,168,308 | 2/1965 | Walton et al. | 271/27 |
| 3,738,645 | 6/1973 | Gray et al. | 271/26 R |
| 3,785,638 | 1/1984 | Beazley | 271/97 X |
| 3,994,488 | 11/1976 | Takenaka | 271/98 |
| 4,184,672 | 1/1980 | Watkins et al. | 271/105 |
| 4,568,073 | 2/1986 | Van Horne | 271/98 X |
| 4,635,917 | 1/1987 | Granot et al. | 271/9 |
| 4,662,622 | 5/1987 | Wimmer | 271/98 X |

FOREIGN PATENT DOCUMENTS

| | | |
|---|---|---|
| 0156756 | 10/1985 | European Pat. Off. . |
| 1230812 | 12/1966 | Fed. Rep. of Germany . |
| 2452052 | 5/1976 | Fed. Rep. of Germany . |
| 2277754 | 2/1976 | France . |

*Primary Examiner*—Richard A. Schacher

*Attorney, Agent, or Firm*—Davis Hoxie Faithfull & Hapgood

[57] ABSTRACT

Apparatus for feeding flexible sheets singly from the top of a stack of sheets comprises a pick-up device which includes a gas deflector and gas supplying holes for directing a stream of gas at the topmost sheet on the stack to cause the sheet to separate from the stack. One of the gas supplying holes also directs a further gas stream at the gas deflector, with this further gas stream attaching itself to the gas deflector by the Coanda effect and entraining the topmost sheet into contact with the gas deflector.

19 Claims, 9 Drawing Sheets

FEEDING OF FLEXIBLE SHEETS

TECHNICAL FIELD

This invention relates to a method of, and apparatus for, feeding flexible sheets singly from the top of a stack of sheets. In particular, but not exclusively, the flexible sheets comprise sheets of fabric used, for example, in the garment manufacturing industry.

BACKGROUND ART

A known sheet feeding apparatus is described in U.S. Pat. No. 4,635,917 and includes table means for supporting a stack of sheets, and a pick-up head for removing the sheets singly from the stack. The pick-up head has air openings for producing air streams along opposite edges of the upper sheet of the stack, each air stream being directed against a cylindrical surface to take advantage of the Coanda effect to lift a sheet edge away from the rest of the stack and to curl it around the cylindrical surface. With the sheet wrapped around two such cylindrical surfaces, the pick-up head is then raised to move the upper sheet from the stack.

DISCLOSURE OF THE INVENTION

The present invention seeks to improve the initial break-away or separation of the upper sheet of a stack of sheets prior to transporting the sheet away from the stack.

According to one aspect of the present invention an apparatus for feeding flexible sheets singly from the top of a stack of sheets comprising means for supporting a plurality of sheets in a stack and at least one pick-up device including a gas deflector and gas supplying means for directing a first stream of gas at said gas deflector, is characterised in that the gas supplying means is arranged to direct a second stream of gas under the gas deflector whereby, in use of the apparatus, gas in said second stream is directed onto the top sheet of a stack supported by said support means to cause initial separation of the top sheet from the rest of the stack prior to being curled upwardly as a result of the first stream of gas being directed at said gas deflector.

Preferably the gas supplying means includes a foot provided with an upper gas opening for generating said first gas stream and a lower gas opening for generating said second gas stream. In this case, the foot may include a further gas deflector positioned between the upper and lower gas openings.

Preferably the apparatus includes means for pulsing the gas in said second stream. It has been found that a pulsed gas stream provides a more effective separation or "break-away" of the top sheet from a stack prior to the subsequent removal of the sheet from the stack.

The first-mentioned gas deflector preferably has a curved surface, e.g. of part cylindrical form. In this case the first gas stream produces a Coanda effect to lift an edge of the topmost sheet from the stack.

Control means are preferably provided to automate operation of the apparatus including controlling initiation and cut-off of said first and second gas streams, the first gas stream being initiated as said second gas stream is cut off.

The gas deflector may be movable relative to the gas supplying means from an inoperative first position when the second stream is directed at the topmost sheet to cause initial separation of the topmost sheet from the rest of the stack, to a second position in which the first stream of gas is arranged to contact the gas deflector and attach itself to the gas deflector by the Coanda effect thereby lifting the topmost sheet into contact with the gas deflector.

According to another aspect of the present invention a method of feeding sheets singly from the top of a stack of sheets comprising directing a first stream of gas at a deflecting surface to create a Coanda effect and lift an edge of the top-most sheet of the stack, is characterised in that a second gas stream is directed under the gas deflector and on to the topmost sheet to cause initial separation of the topmost sheet from the rest of the stack prior to said lifting of said edge.

Preferably the second gas stream is pulsed, e.g. from 1 to 20 Hz, typically 3 Hz.

Preferably the first stream of gas is created as said second stream of gas is cut off.

According to another aspect of the present invention an apparatus for feeding flexible sheets singly from the top of a stack of sheets comprising means for supporting a plurality of sheets in a stack and at least one pick-up device including gas supplying means for directing gas streamwise on to the top sheet of the stack to cause initial break away or separation of the top sheet prior to gripping the top sheet, is characterised in that the gas supplying means is arranged to pulse said directed gas and/or to direct the gas in at least two alternating gas streams. The invention also relates to a method of pulsing air or gas to cause top sheet break away or to a method of alternating air or other gas supplies or air or gas jets to produce a similar pulse like effect by providing at least two alternating streams of air or other gas.

According to a still further aspect of the present invention an apparatus for feeding flexible sheets singly from the top of a stack of sheets comprising means for supporting a plurality of sheets in a stack and at least one pick-up device including gas deflecting means and means for directing gas streamwise towards a top sheet of a stack of sheets, is characterised in that the gas deflecting means defines an open ended passage having inlet and outlet ends and in that the gas deflecting means are movable relative to the gas directing means from a first position in which at least the majority of gas is directed under the gas deflector and on to the topmost sheet to cause initial separation of the topmost sheet from the rest of the stack, to a second position in which at least the majority of gas attaches itself by Coanda effect to an underside of the gas deflector and thereby lifts the topmost sheet from the rest of the stack, to a third position in which at least the majority of gas is directed into the inlet end of the passage producing a surface shear effect on a top surface of the sheet which is attached by Coanda effect to the underside of the gas deflector. In use of such apparatus, a top surface of the leading edge of the sheet which is attached to the underside of the gas deflector becomes entrained in the gas stream issuing from the outlet end of the passage.

Other aspects of the present invention will be apparent from the ensuing description.

BRIEF DESCRIPTION OF THE DRAWINGS

Embodiments of the invention will now be described, by way of example, with reference to the accompanying drawings, in which.

BEST MODES OF CARRYING OUT THE INVENTION

Figure 1:
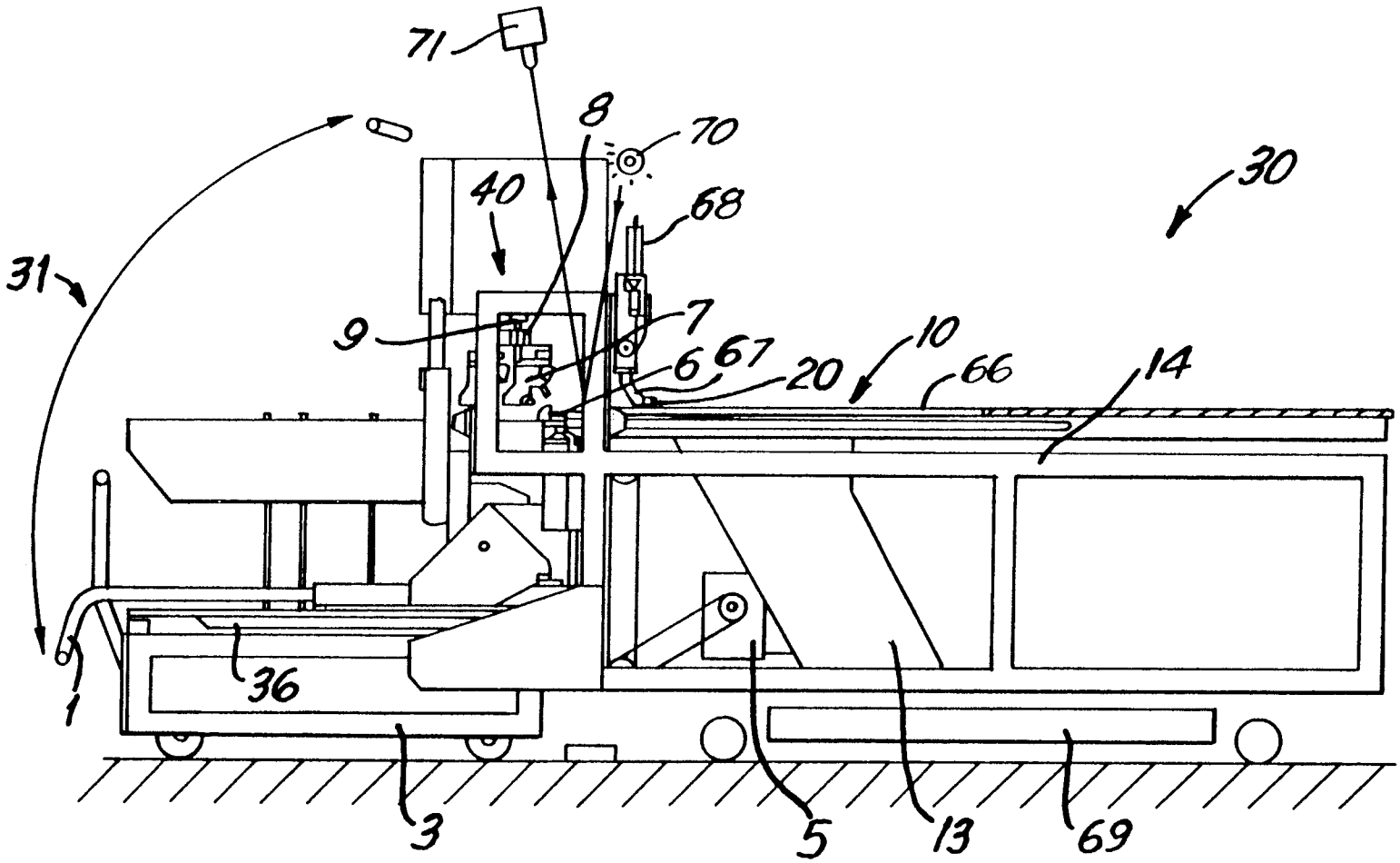
FIG. 1 is a schematic side view of apparatus according to the invention for feeding sheets singly from the top of a stack of sheets.

FIG. 1 shows apparatus, generally designated by the reference numeral 30, for feeding flexible sheets, e.g. of fabric, singly from the top of a stack of sheets (not shown in FIG. 1). The apparatus 1 comprises a main support frame 14, a stack loading station 31, a pick-up unit 40 and a shutter unit 10.

Figure 2:
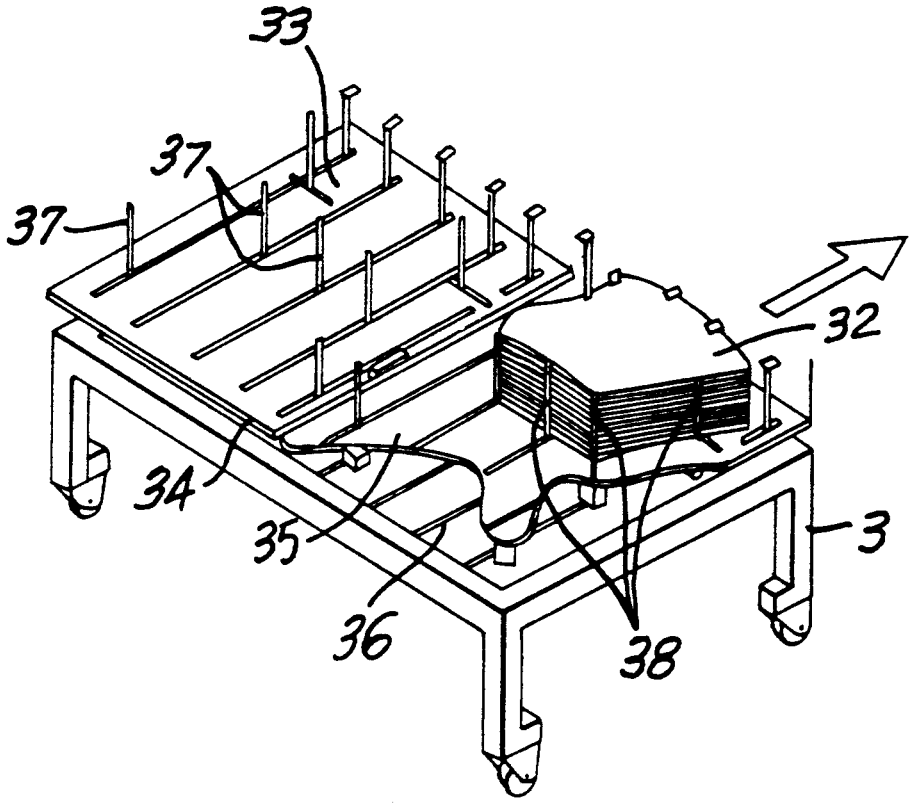
FIG. 2 is a perspective view of a stack of fabric sheets carried on a trolley ready for being loaded into the apparatus shown in FIG. 1, FIGS. 3 and 4 are side and end views, respectively, on enlarged scales of a pick-up head of the apparatus shown in FIG. 1, FIGS. 5 and 6 are schematic side and end views, respectively, of a foot of the pick-up head shown in FIGS. 3 and 4.

Two stacks 32 of sheets (only one stack 32 being shown in FIG. 2) are loaded into the station 31 with the aid of a trolley 3. As can be seen in FIG. 2, each stack is of generally irregular shape corresponding to the fabric shape to be handled subsequently in garment making machinery. Each stack 32 is carried on a pair of slotted upper and lower plates 33, 34 (35, 36), the lower plate 34 (36) having a plurality of adjustable vertical rods 37 (38) fixed around the periphery of the stack and which extend upwardly through slots of the upper plate 33 (35). The upper plates 33 and 35 are movable vertically relative to their respective lower plates 34 and 36 with the rods 37 and 38 ensuring that the sheets of each stack remain in a good stack. The loading station 31 includes a swinging arm 1 pivotable between an upper position for enabling the trolley 3 with stacks thereon to be wheeled into the station 31 and a lower position. On movement of the arm 1 into its lower position the lower plates 34 and 36 are lifted off the trolley and are mounted in a fixed position in the apparatus 1. The loading station also includes a pair of lifting units 5 for independently lifting the upper plates 33, 35 relative to the lower plates 34, 36.

Figure 5:
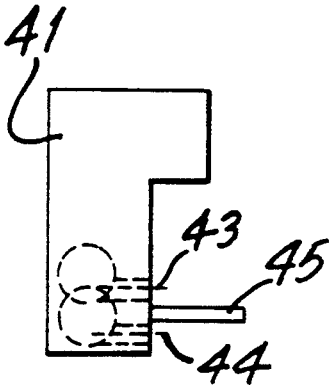
Figure 6:
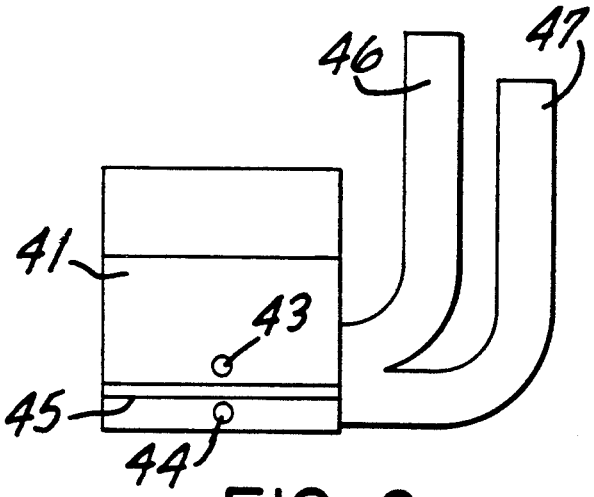

The pick-up unit 40 comprises a plurality, e.g. six, of spaced-apart pick-up heads 6 carried on a cross rail 8 which is movable vertically by an actuator 9. Each pick-up head 6 (see FIGS. 3 to 6) has a foot 41 provided with a frictional grip 42 of resilient material, e.g. of spike-like form, on its bottom surface and incorporates air holes 43 and 44 (see FIGS. 5 and 6) positioned above and below a fixed horizontal air deflector 45. Air under pressure is supplied to air channels in the foot 41 via supply lines 46, 47 to enable streams of air to issue from the air holes 43 and 44.

In front of the foot 41 there is mounted a curved air deflector 48 having a part circular cylindrical peripheral surface. The deflector 48 is mounted at the end of a piston rod 49 controlled by a pneumatic cylinder 50 to enable the deflector 48 to be moved between a lowered position (shown in FIG. 3) or a raised position.

Figure 3:
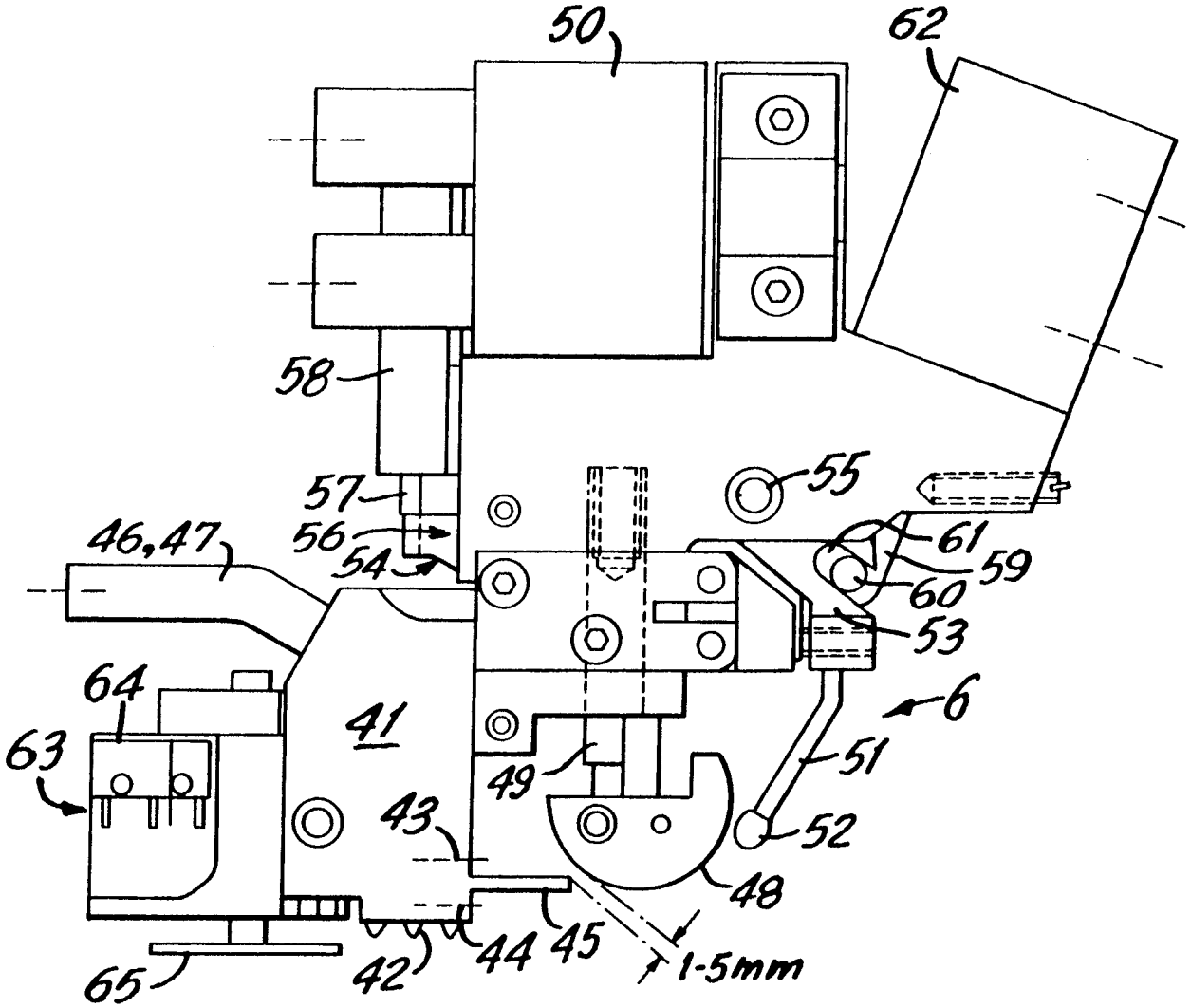
Figure 4:
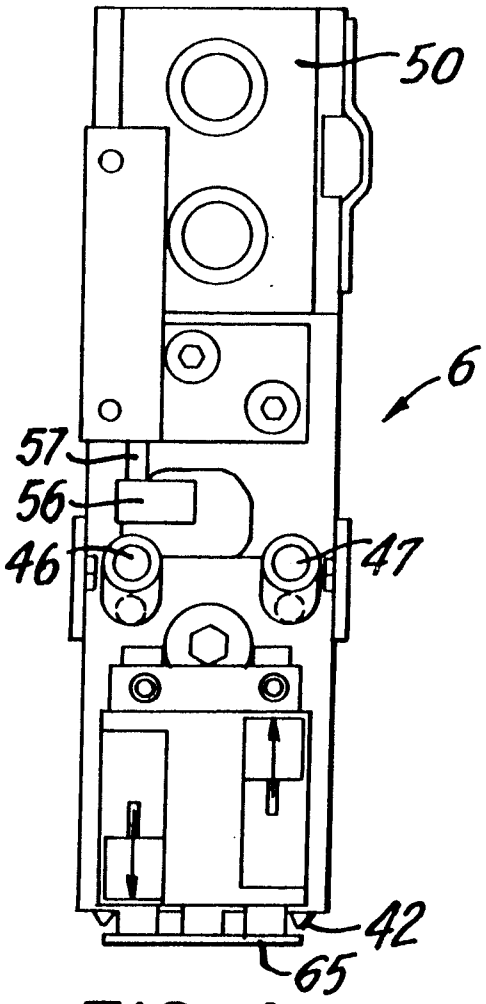

A gripper 51 having a gripping head 52 is fixed to a lever 54 which is pivotable about a spindle 55. The lever 54 contacts one arm of a bell crank lever 56 which pivots about spindle 55. The other arm of lever 56 controls the position of a reciprocative arm 57 of a potentiometer 58 which generates a signal representative of the position of the gripper 51 relative to the deflector 48. A stud 60, mounted on a piston rod 59, is engaged in a slot 61 formed in the arm 53. The piston rod 59 is controlled by a pneumatic cylinder 62 to pivot the bell crank lever 54 and thus to pivot the gripper 51 so that the gripper head 52 is moved between a lower or shut condition (as shown in FIG. 3) for gripping a sheet against the cylindrical surface of the deflector 48 and an upper or open condition.

The pick-up unit 40 further includes a position sensing unit 63 for controlling the position of the lower plate 34 (or 36) so that the upper sheet of a stack is always at the same level. The unit 63 comprises a switch 64 controlled by an actuator 65, the switch 64 controlling the operation of the lifting units 5.

Although not shown in the drawings, an infra red backscatter sensor is mounted on the pick-up head 6. The sensor comprises an infra red emitter for directing an infra red beam at an angle onto the topmost sheet of a stack located in its raised position and a detector for receiving reflected infra red rays. The sensor is designed to measure amplitude vibrations of the top sheet of a stack prior to lifting the sheet from the stack.

Associated with the pick-up head 6 there is a stack edge clamp 7 movable, e.g. electromagnetically, between an upper, inoperative position and a lower, operative position. Conveniently the stack edge clamp 7 is pivotally movable between its upper and lower positions although it may be reciprocably movable, e.g. as shown schematically in FIGS. 8*a*–8*h*.

The shutter unit 10 includes a horizontal shutter 66, having a smooth upper surface, e.g. of polished stainless steel, the shutter being reciprocably movable in a horizontal plane between a retracted home position (shown in FIG. 3) and an outer position in which the shutter is positioned in the stack lifting station 31. Associated with the shutter unit 10 there is a brush off mechanism comprising a brush 20 mounted on a pivoting arm 67. Actuating means 68 pivot the arm 67 between a lower position (as shown in FIG. 1) in which the brush 20 is arranged to contact the upper surface of the shutter 66 and a raised position (not shown). A chute 13 is arranged beneath the brush off mechanism and a wheeled storage box 69 is provided at the bottom of the chute.

The apparatus further includes a light source 70, e.g. a fluorescent tube, and a line scan camera 71. The camera 71 scans across the width of the shutter 66 as the latter moves underneath it and detects information regarding the amount of light reflected off the shutter 66, or off a sheet carried by the shutter, from the light source 70. The information received by the camera 71 is passed to electronic processing apparatus (not shown) for determining the position and orientation of a sheet positioned on the shutter as the latter transports the sheet past the scanning line or for detecting damaged/-faulty sheets.

The apparatus described operates as follows under the control of an electric controller.

Before power is applied to the apparatus those pick-up heads 6 required to "pick" are placed in position with air lines and signal lines connected. Those pick-up heads not in use have their air lines and signal lines disconnected. The redundant picker heads may or may not be removed from the rail 8 as appropriate. With manual mode selected, the power is then applied and, if not already so positioned, lifting tables of the lifting systems 5 are lowered, the shutter 66 is moved to its home position, and the rail 8 lowered. The trolley 3 is then loaded and latched in position by lowering arm 1.

Figure 8A:
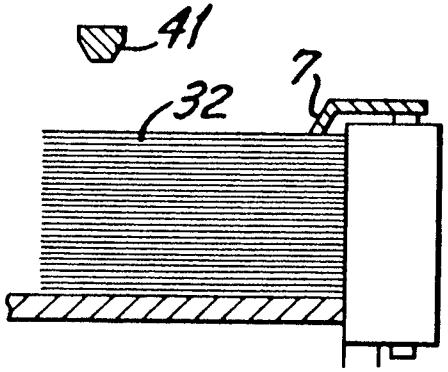
Figure 8B:
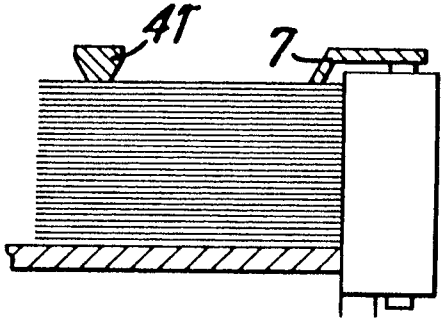

If both tables have been selected then they will rise together, otherwise only the individual table selected will rise. Initially the table(s) rise at a fast speed. The speed is switched to 'slow speed' when a photoswitch (not shown) detects the table(s) are approaching the separation position. The table(s) rise until raised position reached signal(s) are given, by actuation of switch 64 by the top sheet of the stack contacting the actuator 65, whereupon they stop. See FIG. 8*a* showing edge clamps 7 engaging the top sheet of the stack 32. The apparatus will then wait for a command to perform a calibration cycle or a separation cycle.

If a calibration cycle is ordered the rail 8 is raised by energising its actuator, e.g. a solenoid. A shutter sequence initiate signal is then sent. This allows the shutter drive to move the shutter 66 out of the rig (away from home). When the shutter has moved fully to its outer position the shutter drive controller will inform the vision system 70, 71 that this has occurred. The vision system then signals back to the shutter drive to send the shutter back home again. The rail 8 is then lowered (see FIG. 8*b*). This completes the "calibration cycle".

Figure 8C:
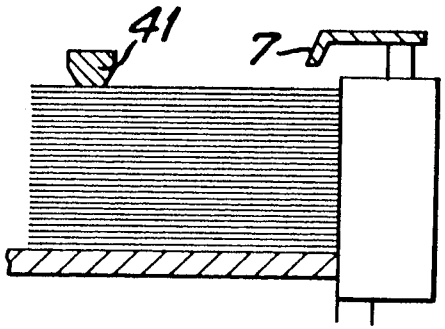
Figure 8D:
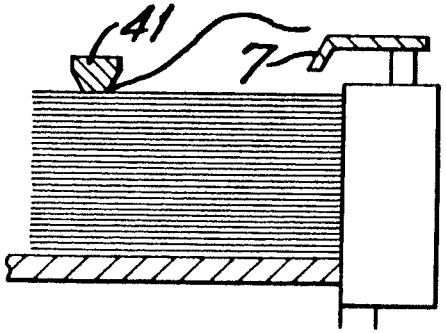

If a separation cycle is selected the edge clamps 7 are raised (see FIG. 8*c*). The controller then decides whether this particular sheet or fabric is either a) the first fabric or b) not the first. If it is the first fabric the deflectors 48 are lowered, the gripper 51 is lowered and each pick-up head 6 is interrogated and its gripper position noted. This value is the 'offset' value and defines the position of the gripper head 52 against the deflector 48 when no sheet or ply is gripped therebetween. Initial "breakout" pressures are then set at a predetermined percentage of full air pressure, if the table is in use, or 0% if the table is not in use. The grippers 51 are then raised followed by the raising of the deflectors 48.

If the fabric is not the first fabric, then initial "breakout" pressures are set at 75% of the average breakout values of the last five successful sheet lifts.

When either the 'first fabric' route or 'not the first fabric' route has been followed the breakout routines are entered. Each pick-up head 6 to be used has air supplied to it under pressure. Initially the air is pulsed at the preset air pressure through the lower of the holes 44 at 3 Hz. The air pressure being pulsed is gradually increased until either the maximum air pressure is reached, after about two seconds, or until the controller has received a 'breakout achieved' signal from breakout circuitry (see FIG. 8*d*). The term "breakout" refers to the detachment of the topmost sheet from the rest of the stack. This is usually evident from the top sheet vibrating on the top of the rest of the stack. If breakout has successfully occurred then the pressure value at which breakout occurred is stored. A new 'average breakout pressure' value is calculated using a rolling average of the last five successful breakout pressure values. This value will be used to set the initial air pressure for the next sheet or ply. It is also a value used by the 'liftoff' routine for this sheet.

When liftoff routine is entered, the air supply is switched to the top hole 44 and into a continuous, non-pulsed mode. Two routes can then be followed, depending upon whether the fabric is a "new" fabric or not a new fabric. If the sheet is a new fabric then the deflectors 48 are lowered. Following a delay, the grippers 51 are closed and an operator checks firstly that one sheet only has been picked, and secondly that each pick-up head 6 that was supposed to pick has indeed picked. If this is not the case he will press a 'reset' pushbutton. The controller will then raise the gripper 51 and the deflector 48, and repeat a pick attempt by lowering the deflector 48 and the gripper 51. Up to three repeats can be attempted before an error is signalled to the system controller. If a pick has been attempted and an operator confirms that the pick was indeed achieved, then he will press the start pushbutton. This will signal to the controller that the sheet has been picked successfully and to read in each pick-up head's thickness reading sensed by the potentiometer 58. For each pick-up head 6, the controller will work out the true thickness of the cloth at that point by subtracting the value it has just read in from the offset value. It will then calculate upper and lower thickness acceptance limits of 50% for that pick-up head, for use as test limits for future sheets of the same sort of fabric to determine whether that pick-up head has picked zero, one or more than one ply. In addition, flags are set to show which pick-up heads 6 are indeed in use, and which are not.

If the sheet picked is not a new fabric, then the deflectors 48 and grippers 51 are lowered. Each of the pick-up heads 6 being used is then interrogated. The thickness as read in by each pick-up head is noted and compared with the two limits previously calculated and stored for that pick-up head for the particular type of fabric. For each pick-up head, one of three "pick" status flags is set, namely 'zero ply picked', 'one ply picked' or 'more than one ply picked'. After every pick-up head in use has been interrogated, the "pick" status flags are evaluated. If all 'one ply picked' flags are set, it is assumed that the apparatus has successfully picked one sheet or ply and may continue with the cycle. If any of the 'zero ply picked' flags or 'more than one ply picked' flags have been set, then it is assumed that the pick was unsuccessful and a repeat attempt is necessary (up to a maximum of three attempts). However, there is one special case where each pick-up head has its 'zero ply picked' flag set and a 'last 5% of stack' switch is made. It is then assumed the stack has run out. This will be signalled to the system controller and the apparatus stops, awaiting operator intervention. If an unsuccessful pick has been signalled, however, then the lift off air is first adjusted. It is either increased by 25% or remains the same, depending upon the combination of pick status flags set. Once adjusted the grippers 51 and deflectors 48 are raised. Following a delay, the deflectors 48 are lowered again, and, after another short delay, the grippers 51 are also re-lowered. The reinterrogation of each of the pick-up heads in use and the evaluation of their pick status flags is performed again. Up to three attempts to pick one sheet can be made before an error is signalled to the system controller, and the apparatus stops, awaiting operator intervention.

If a successful pick has been signalled then each of the pick-up heads upper and lower limits are recalculated. For each pick-up head the thickness value of the sheet recorded during pick-up head interrogation is averaged, with the last four sheet thickness readings. From this, new 50% upper and lower values are calculated. These new values will be used for the next sheet. When either the 'new fabric' route or the 'not new fabric' route has been successfully followed without an error being signalled to the system controller then the separation cycle can continue. It should be noted that the above description is for the one stack, e.g. the left-hand side (LHS) table system only. The right-hand side (RHS) table system follows the same scenario.

Figure 8E:
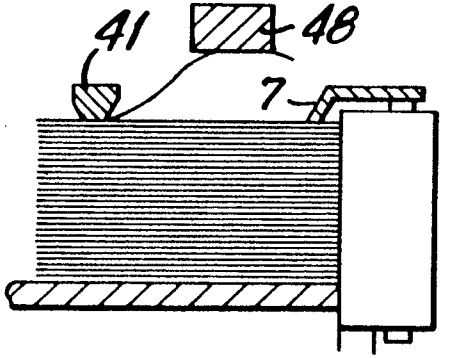
Figure 8F:
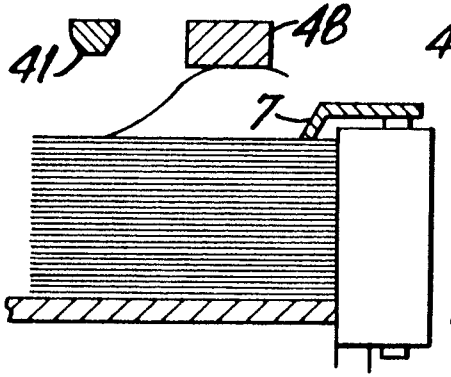
Figure 8G:
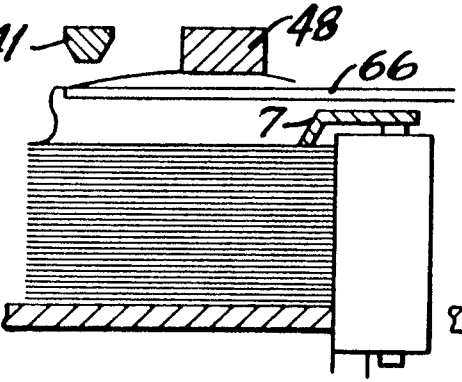
Figure 8H:
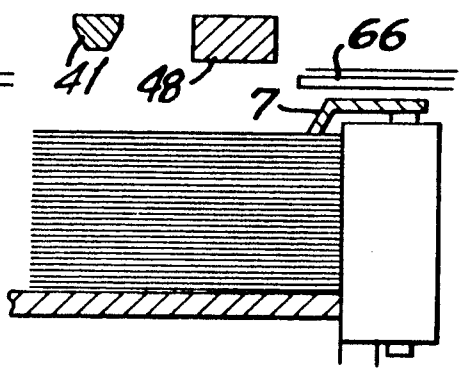

The next step in the cycle is to lower the edge clamps 7 (see FIG. 8*e*). The rail 8 is then raised (see FIG. 8*b*). When the rail 8 has been fully raised, the controller signals to the shutter drive to drive the shutter 66 away from home. The shutter moves off when instructed to do so by the drive (see FIG. 8*g*). When ¾ of the way out, the gripper 51 is raised, depositing the sheet upon the shutter 66. When the shutter drive senses the shutter has moved to the fully out position, the shutter will stop, and the drive will signal to the vision system 70, 71 that it is awaiting the vision systems command to drive the shutter back home. When the drive receives this signal, the shutter 66 is driven back home (see FIG. 8*h*) carrying the sheet on its upper surface. When the shutter is home, the rail 8 is lowered again and the table(s) are re-adjusted to a new separation position ready for the sequence to start again for picking up another sheet from the top of the stack. The sheet or ply supported on the shutter 66 is then automatically slid off the shutter 66 by operation of a robot having a gripper pad at the end of its arm.

It is possible that during movement of the shutter back to home, the vision system 70, 71 detects a fault, e.g. a tear, in the sheet or ply carried on the shutter. In this case the brush off mechanism is actuated by lowering the arm 67 so that the brush 20 contacts the shutter 66 when the latter is home. The sheet is not then moved off the shutter by a robot. In the next sequence, when the shutter 66 is moved out of home, the brush 20 will cause the sheet to be swept off the back of the shutter 66 as it moves beneath the sheet. The rejected sheet will fall through the chute 13 and into the storage box 69.

Figure 9:
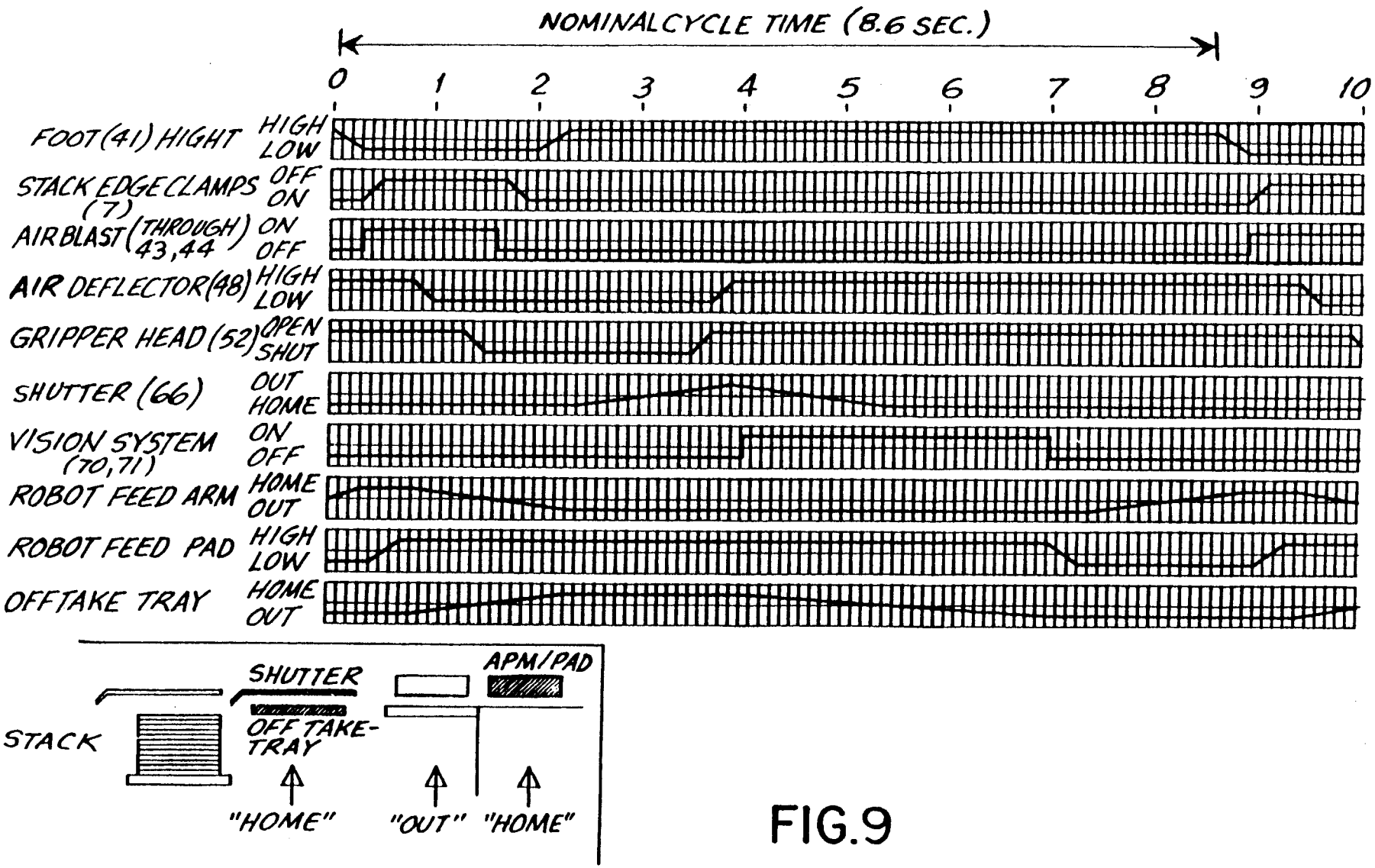
FIG. 9 is a timing chart illustrating the operation of the apparatus shown in FIG. 1, FIGS. 10A and 10B together comprise a flow chart illustrating how the apparatus shown in FIG. 1 is controlled.
Figure 10A:
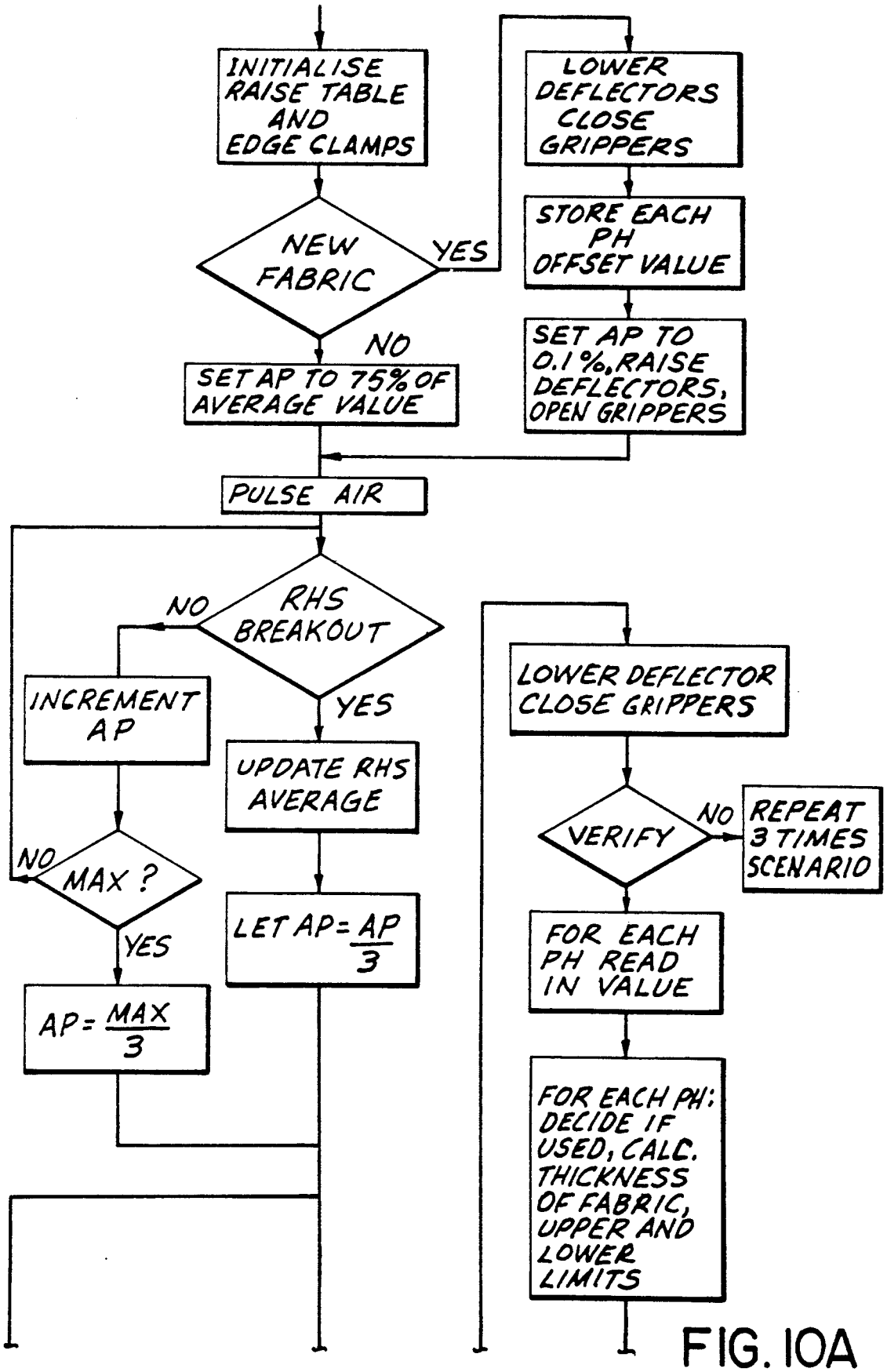
Figure 10B:
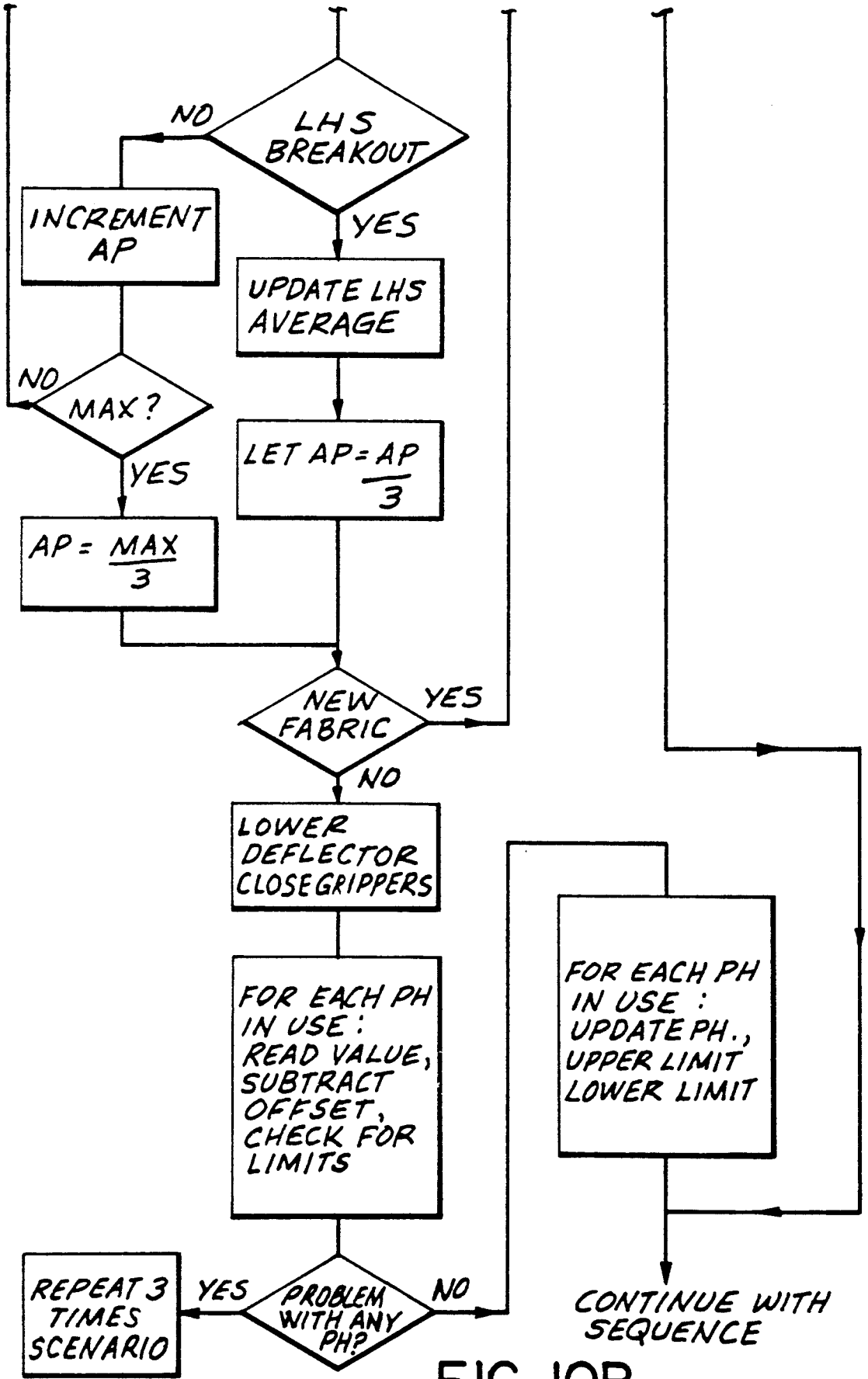

The flow chart shown in FIGS. 10A and 10B and the timing chart shown in FIG. 9 illustrate the operating cycle described above.

The pick-up and left off technique described above makes use of two air streams. One air stream (the first to come into operation) directs pulsed air out of the lower air hole 44 to cause the top-most sheet to break away or separate from the stack. Increased air pressure of the pulsed air increases the amplitude of vibration of the topmost sheet assisting break away. This vibration is sensed by the infra red sensing unit previously referred to. Break away can be achieved by directing a continuous, non-pulsed air stream through the air hole 44. However break away achieved with most fabrics tested is vastly improved if a pulsed air stream is employed. Instead of a single pulsed air stream, two or more alternating air streams, possibly also pulsed, could be provided. The other air stream (which comes into operation to effect "lift off" after the "break away" has been achieved) directs a continuous, non-pulsed stream of air towards the lower, part cylindrical surface of the deflector 48. The deflector 48 assists in directing the flow of this continuous air stream toward the deflector 48. The air stream so produced creates a Coanda effect around the deflector 48 so that the leading edge of the topmost sheet is sucked up and drawn around the curved, part cylindrical surface of the deflector 48.

Figure 7:
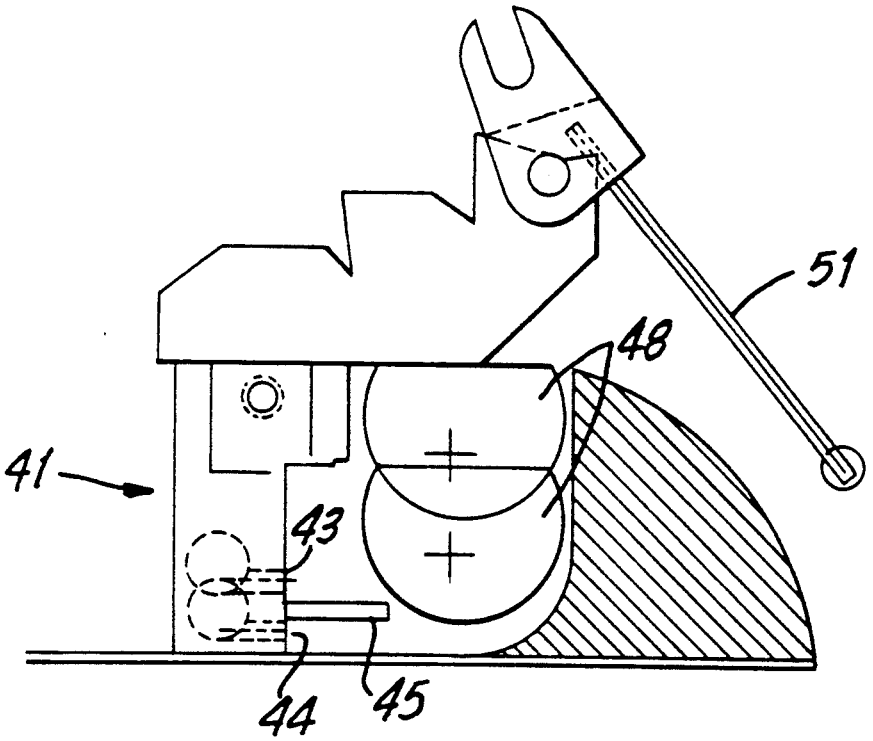
FIG. 7 is a schematic view of a modified pick-up head illustrating how a leading edge of a top sheet is lifted from a stack, FIGS. 8*a*–8*h* schematically illustrate the operating sequence of the apparatus shown in FIG. 1.

A slightly modified pick-up head is shown in FIG. 7 employing a slightly different gripper 51 and showing the deflector 48 in its upper and lower positions. The shaded portion of FIG. 7 schematically illustrates the path that the leading edge of the topmost sheet sweeps when being lifted or curled up as a result of the Coanda effect.

Figure 12:
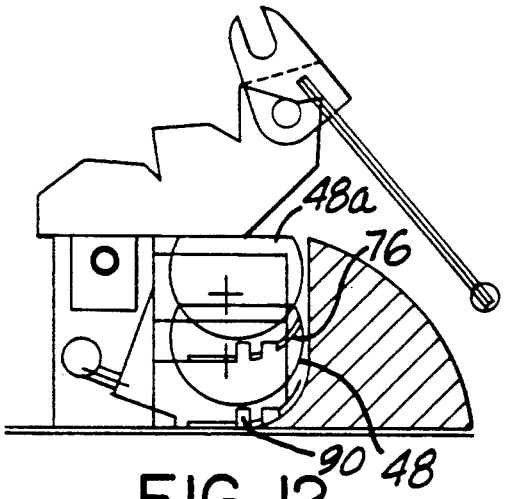
FIGS. 12 and 13 are schematic views of further modified pick-up heads illustrating said further aspect of the invention.
Figure 13:
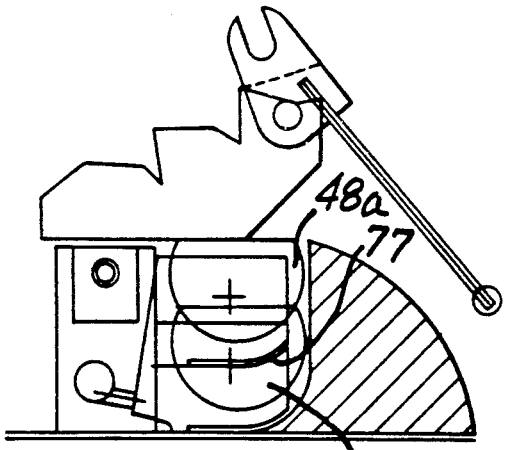

In accordance with another aspect of the invention, the air deflector 48 includes a shroud 75 (see FIG. 11) fitted to an upper member 48*a* to alter the method of sheet break away and lift off. Various other embodiments of deflector 48 fitted with shrouds 76 and 77 are shown in FIGS. 12 and 13. In each case effectively two streams of air are provided from a common air discharge nozzle. These air streams are directed from the foot of the pick-up head.

Figure 11:
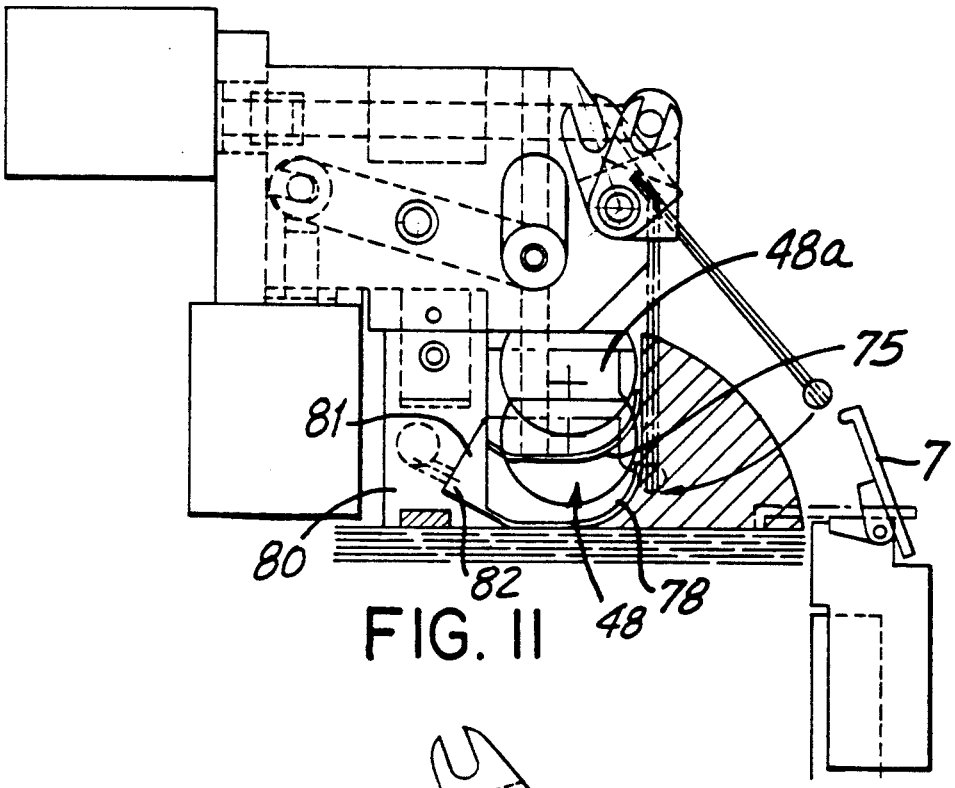
FIG. 11 is a schematic view of a modified pick-up head illustrating a further aspect of the present invention.

With regard to the embodiment shown in FIG. 11, the shroud 75 is mounted to surround the lower part of the upper member 48*a* and to define a narrowing air passage 78 between itself and the upper member 48*a*. The foot 80 has a cut-out 81 therein into which an air opening 82 opens. The cut-out 81 is shaped to direct air issuing from the air opening 82 in a downwards direction. In use air in a continuous stream issues downwardly from the air opening 82 to impinge on the topmost sheet to cause "break away". In this condition the deflector 48 is in its raised position. The deflector 48 is then lowered to a first position. When the deflector 48 is lowered to the first position the air issuing from the opening 82 attaches to the outer surface of the shroud 75 due to the Coanda effect and this in turn causes the top sheet to become attached to the shroud. When the deflector 48 reaches a second position, lower than the first position, it engages a wall of the cut-out 81 and all the air issuing from the air opening 82 is directed into the air passage 78 between member 48*a* and the shroud 75. A surface shear effect is produced around the inside of the shroud 75 and any curled up leading edge of a sheet (or sheets if more than one is lifted) which projects over the rear lip of the shroud 75 becomes entrained in the air stream Any additional sheets initially lifted with the top sheet fall off the underside of the sheet back on to the stack. When the gripper 51 is lowered, the gripper head is thus able to grip the entrained leading edge of the fabric against the outside of the shroud 75. It will be appreciated that a Coanda effect is obtained as the shroud 75 is moved downwardly into the second position. As the shroud 75 approaches the air stream from above, the low pressure created around the underside of the shroud 75 causes the reading edge of the top-most sheet to curl up just before the shroud reaches its lowered position. The provision of a shroud is particularly important for removing sheets of porous fabric, e.g. lace. With porous fabric, the pulsed air method previously described may cause more than one of the top layers of the stack to break away because the air jet tends to pass through the porous fabric and entrain more than one ply. With the provision of a shroud, break away of only a single top sheet is obtained with greater regularity because the air flow between upper member 48*a* and the shroud 75 is less likely to flow through the porous top layer due to the fact that the air is moving parallel to the ply which is attached to the outside of the shroud. It will be appreciated that FIG. 7 illustrates a pivoting stack edge clamp 7 actuated, for example, electromagnetically.

Other shroud and cut-out designs are shown in FIGS. 12 and 13. In FIG. 12, two elongate slots 90, 91, extending parallel to the axis of the part cylindrical member 48*a*, are formed in the shroud 76. The air flowing in the space between the member 48*a* and the shroud 76, draws it through the slots 90, 91 by an ejector effect. This causes low pressure to be formed beneath the slots 90, 91 and increases the mass flow through the narrowing passage between the member 48*a* and shroud 76. This low air pressure assists in curling up the leading edge of the top sheet. In FIG. 13, the cut-out 81 has a curved wall. In both FIGS. 12 and 13, a gap is left between the foot and the shroud when the deflector is in its lowered position.

We claim:

1. In an apparatus for feeding flexible sheets singly from the top of a stack of sheets comprising support means for supporting a plurality of sheets in a stack and at least one pick-up device including a gas deflector and gas supplying means for directing a first stream of gas at said gas deflector, the improvement wherein the gas supplying means is spaced apart from the gas deflector, the gas deflector is movable relative to the gas supplying means from a first position to a second position, and the gas supplying means is arranged to direct a second stream of gas under the gas deflector whereby, in use of the apparatus, gas in said second stream is directed onto the top sheet of a stack supported by said support means to cause initial separation of the top sheet from the rest of the stack, when said gas deflector is in the first position, and wherein the first stream of gas is arranged to attach itself to the gas deflector by the Coanda effect, when said gas deflector is in the second position, thereby lifting and curling upwardly the topmost sheet, after initial separation by the second stream of gas, into contact with the gas deflector.

2. An apparatus according to claim 1, in which the gas supplying means includes a foot provided with an upper gas opening for generating said first gas stream and a lower gas opening for generating said second gas stream.

3. An apparatus according to claim 2, in which the foot includes a further gas deflector positioned between the upper and lower gas openings.

4. An apparatus according to claim 1, comprising pulse means for pulsing the gas in said second stream.

5. An apparatus according to claim 1, comprising directing means for directing said second stream of gas in at least two alternating gas streams.

6. An apparatus according to claim 1, in which the first-mentioned gas deflector has a curved surface.

7. An apparatus according to claim 1, comprising control means for controlling initiation and cut-off of said first and second gas streams so that the first gas stream is initiated as said second gas stream is cut off.

8. An apparatus according to claim 1, in which the first and second gas streams are derived from a common discharge opening.

9. An apparatus according to claim 1, in which said gas deflector is positioned in a lower position when in its second position than when in its first position.

10. An apparatus according to claim 8, in which the gas deflector defines an open ended passage having inlet and outlet ends, and in that the gas deflector is movable relative to the gas supplying means from a first position, in which at least the majority of the gas from said discharge opening is directed in said second stream under the gas deflector and on to the topmost sheet to cause said initial separation of the topmost sheet from the rest of the stack, to a second position, in which at least the majority of the gas from said discharge opening attaches itself by Coanda effect to an underside of the gas deflector and thereby lifts the topmost sheet form the rest of the stack, to a third position where at least the majority of the gas from said discharge opening is directed in said first stream into the inlet end of the passage and produces a surface shear effect on a top surface of the sheet which is attached by the Coanda effect to the underside of the gas deflector.

11. An apparatus according to claim 10, in which the said gas deflector is positioned in a lower position when in its second position than when in its first position.

12. An apparatus according to claim 10, in which the gas deflector comprises an upper member having a curved first surface and a shroud having a curved second surface, the shroud being attached to the upper member with said first and second surfaces spaced from each other to define the said open ended passage.

13. An apparatus according to claim 12, in which the shroud has at least one opening in the second surface.

14. An apparatus according to claim 12, in which the upper member has an at least partly cylindrical form the outer peripheral surface of which provides the said curved first surface.

15. A method of feeding sheets singly from the top of a stack of sheets in an apparatus having a gas deflector which is movable between a first position and a second position comprising directing a second gas stream under the gas deflector when the gas deflector is in the first position and on to the topmost sheet of the stack to cause initial separation of the topmost sheet from the rest of the stack, moving the gas deflector to the second position and directing a first stream of gas at the gas deflector to create a Coanda effect and lift and curl upwardly an edge of the topmost sheet of the stack when the gas deflector is in the second position.

16. A method according to claim 13, in which the second gas stream is pulsed.

17. A method according to claim 16, in which the second gas stream is pulsed at a frequency of from 1 to 20 Hz.

18. A method according to claim 13, in which the first gas stream is created as said second gas stream is cut off.

19. A method according to claim 13, in which the gas in said first and second streams is derived from a common discharge opening, gas being formed into said first stream as the gas deflector is lowered from the second position to a third position by being constrained to flow through an open ended passage in the gas deflector, the said first stream creating a surface shear effect on a top surface of the sheet previously attached by Coanda effect to the underside of the gas deflector.

* * * * *

UNITED STATES PATENT AND TRADEMARK OFFICE

CERTIFICATE OF CORRECTION

PATENT NO. : 5,263,700
DATED : November 23, 1993
INVENTOR(S) : Anthony B. Tubb, et al.

It is certified that error appears in the above-indentified patent and that said Letters Patent is hereby corrected as shown below:

| | | |
|---|---|---|
| Col. 10, | line 49 | (claim 16) cancel "13" and substitute --15--. |
| Col. 10, | line 54 | (claim 18) cancel "13" and substitute --15--. |
| Col. 10, | line 56 | (claim 19) cancel "13" and substitute --15--. |

Signed and Sealed this

Seventh Day of June, 1994

Bruce Lehman

*Attest:*

BRUCE LEHMAN

*Attesting Officer*

*Commissioner of Patents and Trademarks*